US005204905A

United States Patent [19]

Mitome

[11] Patent Number: 5,204,905

[45] Date of Patent: Apr. 20, 1993

[54] TEXT-TO-SPEECH SYNTHESIZER HAVING FORMANT-RULE AND SPEECH-PARAMETER SYNTHESIS MODES

[75] Inventor: Yukio Mitome, Tokyo, Japan

[73] Assignee: NEC Corporation, Tokyo, Japan

[21] Appl. No.: 529,421

[22] Filed: May 29, 1990

[30] Foreign Application Priority Data

May 29, 1989 [JP] Japan ..... 1-135595

[51] Int. Cl.[5] ..... G10L 5/02; G10L 9/10

[52] U.S. Cl. ..... 381/52; 381/51; 381/53; 364/724.17

[58] Field of Search ..... 381/51-53; 364/724.16, 724.17

[56] References Cited

U.S. PATENT DOCUMENTS

| | | | |
|---|---|---|---|
| 4,467,440 | 8/1984 | Sano et al. | 364/724.17 |
| 4,489,391 | 12/1984 | Morikawa | 364/724.17 |
| 4,541,111 | 9/1985 | Takashima et al. | 381/51 |
| 4,597,318 | 7/1986 | Nikaido et al. | 381/51 |
| 4,692,941 | 9/1987 | Jacks et al. | 381/52 |
| 4,829,573 | 5/1989 | Gagnon et al. | 381/53 |
| 4,979,216 | 12/1990 | Matsheen et al. | 381/52 |

FOREIGN PATENT DOCUMENTS

| | | | |
|---|---|---|---|
| 0274200 | 11/1989 | Japan | 381/53 |

OTHER PUBLICATIONS

"Japanese Text-To-Speech Synthesizer Based on Residual Excited Speech Synthesis" by Kazuo Hakoda et al., *ICASSP 86, Tokyo,* pp. 2431-2434.

"Speech Synthesis by Rule" Chapter 6 of *Speech Synthesis and Recognition* by J. N. Holmes, pp. 81-101, Mar. 30, 1963.

*Primary Examiner*—Dale M. Shaw
*Assistant Examiner*—Kee M. Tung
*Attorney, Agent, or Firm*—Sughrue, Mion, Zinn, Macpeak & Seas

[57] ABSTRACT

A text-to-speech synthesizer comprises an analyzer that decomposes a sequence of input characters into phoneme components and classifies them as a first group of phoneme components or a second group if they are to be synthesized by a speech parameter or by a formant rule, respectively. Speech parameters derived from natural human speech are stored in first memory locations corresponding to the phoneme components of the first group and the stored speech parameters are recalled from the first memory in response to each of the phoneme components of the first group. Formant rules capable of generating formant transition patterns are stored in second memory locations corresponding to the phoneme components of the second group, the formant rules being recalled from the second memory in response to each of the phoneme components of the second group. Formant transition patterns are derived from the formant rule recalled from the second memory, and formants of the derived transition patterns are converted into corresponding speech parameters. Spoken words are digitally synthesized from the speech parameters recalled from the first memory as well as from those supplied from the converted speech parameters.

6 Claims, 4 Drawing Sheets

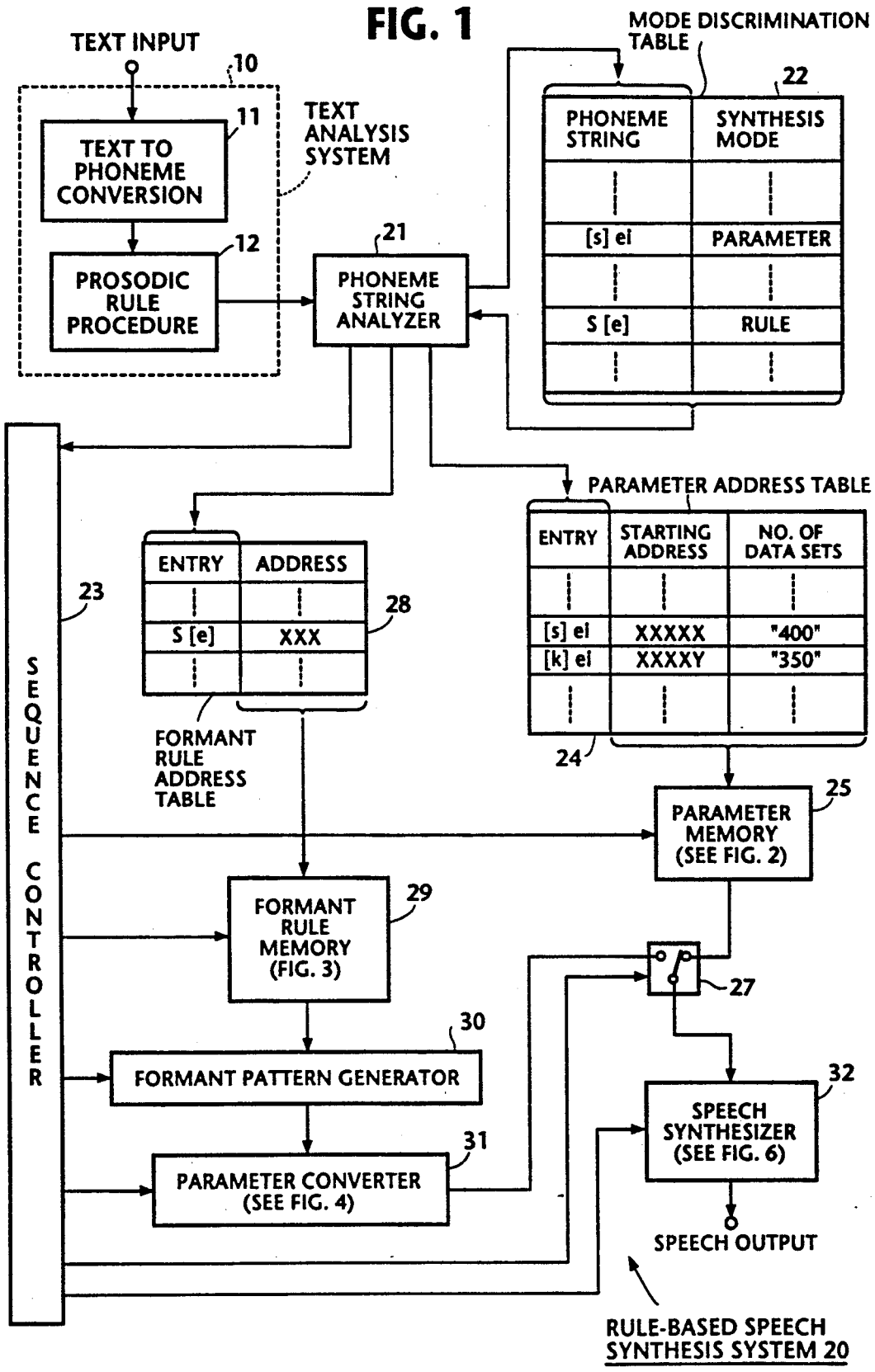
FIG. 1
TEXT INPUT
10
TEXT TO PHONEME CONVERSION
11
PROSODIC RULE PROCEDURE
12
TEXT ANALYSIS SYSTEM
PHONEME STRING ANALYZER
21
MODE DISCRIMINATION TABLE
22
PHONEME STRING
SYNTHESIS MODE
[s] ei
PARAMETER
S [e]
RULE
PARAMETER ADDRESS TABLE
ENTRY
STARTING ADDRESS
NO. OF DATA SETS
[s] ei
XXXXX
"400"
[k] ei
XXXXY
"350"
24
ENTRY
ADDRESS
S [e]
XXX
28
FORMANT RULE ADDRESS TABLE
23
SEQUENCE CONTROLLER
PARAMETER MEMORY (SEE FIG. 2)
25
FORMANT RULE MEMORY (FIG. 3)
29
27
FORMANT PATTERN GENERATOR
30
PARAMETER CONVERTER (SEE FIG. 4)
31
SPEECH SYNTHESIZER (SEE FIG. 6)
32
SPEECH OUTPUT
RULE-BASED SPEECH SYNTHESIS SYSTEM 20

FIG. 2

FROM ADRS TABLE 24

PARAMETER MEMORY 25

| ADRS | SOURCE CODE | | AR PARAMETER | MA PARAMETER |
|---|---|---|---|---|
| | PULSE SHAPE | AMPL-ITUDE | | |
| ⋮ | ⋮ | ⋮ | ⋮ | ⋮ |
| XXXXX | n/p | $L_1$ | $a_1, a_2, \ldots a_N, a_{N+1}, \ldots a_{2N}$ | $b_1, b_2, \ldots b_N, b_{N+1}, \ldots b_{2N}$ |
| | n/p | $L_2$ | $a_1, a_2, \ldots a_N, a_{N+1}, \ldots a_{2N}$ | $b_1, b_2, \ldots b_N, b_{N+1}, \ldots b_{2N}$ |
| | ⋮ | ⋮ | ⋮ | ⋮ |
| | n/p | $L_{400}$ | $a_1, a_2, \ldots a_N, a_{N+1}, \ldots a_{2N}$ | $b_1, b_2, \ldots b_N, b_{N+1}, \ldots b_{2N}$ |
| | ⋮ | ⋮ | ⋮ | ⋮ |

TO SWITCH 27

FIG. 3

FROM ADRS TABLE 28

FORMANT RULE MEMORY 29

| ADRS | FORMANTS | ANTIFORMANTS |
|---|---|---|
| ⋮ | ⋮ | ⋮ |
| XXX | $F_1\ (t_{11}, f_{11})\ (t_{12}, f_{12}) \ldots (t_{1n}, f_{1n})$<br>⋮<br>$F_N\ (t_{N1}, f_{N1})\ (t_{N2}, f_{N2}) \ldots (t_{Nk}, f_{Nk})$<br>$B_1\ (t_{N+1,1}, b_{11})\ (t_{N+1,2}, b_{12})$<br>⋮<br>$B_N\ (t_{2N,1}, b_{N1})\ (t_{2N,2}, b_{N2})$ | $AF_1\ (t_{11}, f_{11})\ (t_{12}, f_{12}) \ldots (t_{1m}, f_{1m})$<br>⋮<br>$AF_N\ (t_{N1}, f_{N1})\ (t_{N2}, f_{N2}) \ldots (t_{Nl}, f_{Nl})$<br>$AB_1\ (t_{N+1,1}, b_{11})\ (t_{N+1,2}, b_{12})$<br>⋮<br>$AB_N\ (t_{2N,1}, b_{N1})\ (t_{2N,2}, b_{N2})$ |
| ⋮ | ⋮ | ⋮ |

TO FORMANT PATTERN GENERATOR 30

PARAMETER CONVERTER 31

TEXT-TO-SPEECH SYNTHESIZER HAVING FORMANT-RULE AND SPEECH-PARAMETER SYNTHESIS MODES

BACKGROUND OF THE INVENTION

The present invention relates generally to speech synthesis systems, and more particularly to a text-to-speech synthesizer.

Two approaches are available for text-to-speech synthesis systems. In the first approach, speech parameters are extracted from human speech by analyzing semisyllables, consonants and vowels and their various combinations and stored in memory. Text inputs are used to address the memory to read speech parameters and an original sound corresponding to an input character string is reconstructed by concatenating the speech parameters. As described in "Japanese Text-to-Speech Synthesizer Based On Residual Excited Speech Synthesis", Kazuo Hakoda et al., ICASSP '86 (International Conference On Acoustics Speech and Signal Processing '86, Proceedings 45-8, pages 2431 to 2434), Linear Predictive Coding (LPC) technique is employed to analyze human speech into consonant-vowel (CV) sequences, vowel (V) sequences, vowel-consonant (VC) sequences and vowel-vowel (VV) sequences as speech units and speech parameters known as LSP (Line Spectrum Pair) are extracted from the analyzed speech units. Text input is represented by speech units and speech parameters corresponding to the speech units are concatenated to produce continuous speech parameters. These speech parameters are given to an LSP synthesizer. Although a high degree of articulation can be obtained if a sufficient number of high-quality speech units are collected, there is a substantial difference between sounds collected from speech units and those appearing in texts, resulting in a loss of naturalness. For example, a concatenation of recorded semisyllables lacks smoothness in the synthesized speech and gives an impression that they were simply linked together.

According to the second approach, rules for formant are derived from strings of phonemes and stored in a memory as described in "Speech Synthesis And Recognition", pages 81 to 101, J. N. Holmes, Van Nostrand Reinhold (UK) Co. Ltd. Speech sounds are synthesized from the formant transition patterns by reading the formant rules from the memory in response to an input character string. While this technique is advantageous for improving the naturalness of speech by repetitive experiments of synthesis, the formant rules are difficult to improve in terms of constants because of their short durations and low power levels, resulting in a low degree of articulation with respect to consonants.

SUMMARY OF THE INVENTION

It is therefore an object of the present invention to provide a text-to-speech synthesizer which provides high-degree of articulation and high degree of flexibility to improve the naturalness of synthesized speech.

This object is obtained by combining the advantageous features of the speech parameter synthesis and the formant rule-based speech synthesis.

According to the present invention, there is provided a text-to-speech synthesizer which comprises an analyzer that decomposes a sequence of input characters into phoneme components and classifies them as a first group of phoneme components or a second group if they are to be synthesized by a speech parameter or by a formant rule, respectively. Speech parameters derived from natural human speech are stored in first memory locations corresponding to the phoneme components of the first group and the stored speech parameters are recalled from the first memory in response to each of the phoneme components of the first group. Formant rules capable of generating formant transition patterns are stored in second memory locations corresponding to the phoneme components of the second group, the formant rules being recalled from the second memory in response to each of the phoneme components of the second group. Formant transition patterns are derived from the formant rule recalled from the second memory. A parameter converter is provided for converting formants of the derived formant transition patterns into corresponding speech parameters. A speech synthesizer is responsive to the speech parameters recalled from the first memory and to the speech parameters converted by the parameter converter for synthesizing a human speech.

BRIEF DESCRIPTION OF THE DRAWINGS

The present invention will be described in further detail with reference to the accompanying drawings, in which:

FIG. 1 is a block diagram of a rule-based text-to-speech synthesizer of the present invention;

FIG. 2 shows details of the parameter memory of FIG. 1;

FIG. 3 shows details of the formant rule memory of FIG. 1;

DETAILED DESCRIPTION

Figure 4:
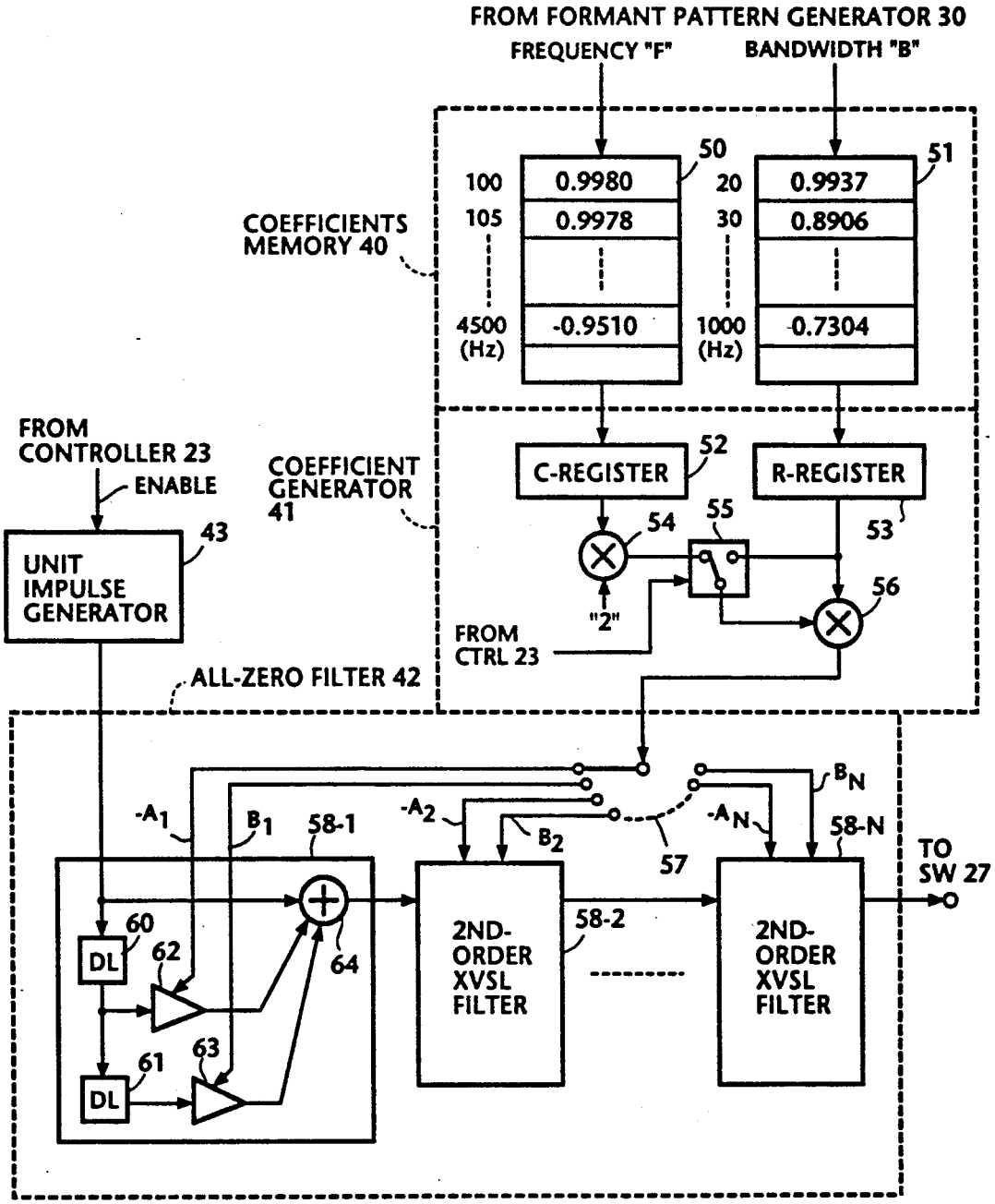
FIG. 4 is a block diagram of the parameter converter of FIG. 1.

In FIG. 1, there is shown a text-to-speech synthesizer according to the present invention. The synthesizer of this invention generally comprises a text analysis system 10 of well known circuitry and a rule-based speech synthesis system 20. Text analysis system 10 is made up of a text-to-phoneme conversion unit 11 and a prosodic rule procedural unit 12. A text input, or a string of characters is fed to the text analysis system 10 and converted into a string of phonemes. If a word "say" is the text input, it is translated into a string of phonetic signs "s[t 120] ei [t 90, f (0, 120) (30, 140) . . . ]", where t in the brackets [] indicates the duration (in milliseconds) of a phoneme preceding the left bracket and the numerals in each parenthesis respectively represent the time (in milliseconds) with respect to the beginning of a phoneme preceding the left bracket and the frequency (Hz) of a component of the phoneme at each instant of time.

Rule-based speech synthesis system 20 comprises a phoneme string analyzer 21 connected to the output of text analysis system 10 and a mode discrimination table 22 which is accessed by the analyzer 21 with the input phoneme strings. Mode discrimination table 22 is a dictionary that holds a multitude of sets of phoneme strings and corresponding synthesis modes indicating whether the corresponding phoneme strings are to be synthesized with a speech parameter or a formant rule. The application of the phoneme strings from analyzer 21 to table 22 will cause phoneme strings having the same phoneme as the input string to be sequentially read out of table 22 into analyzer 21 along with corresponding synthesis mode data. Analyzer 21 seeks a match between each of the constituent phonemes of the input string with each phoneme in the output strings from table 22 by ignoring the brackets in both of the input and output strings.

Using the above example, there will be a match between the input characters "se" and "S[e]" in the output string and the corresponding mode data indicates that the character "S" is to be synthesized using a formant rule. Analyzer 21 proceeds to detect a further match between characters "ei" of the input string and the characters "ei" of the output string "[s]ei" which is classified as one to be synthesized with a speech parameter. If "parameter mode" indication is given by table 22, analyzer 21 supplies a corresponding phoneme to a parameter address table 24 and communicates this fact to a sequence controller 23. If a "formant mode" indication is given, analyzer 21 supplies a corresponding phoneme to a formant rule address table 28 and communicates this fact to controller 23.

Sequence controller 23 supplies various timing signals to all parts of the system. During a parameter synthesis mode, controller 23 applies a command signal to a parameter memory 25 to permit it to read its contents in response to an address from table 24 and supplies its output to the left position of a switch 27, and thence to a digital speech synthesizer 32. During a rule synthesis mode, controller 23 supplies timing signals to a formant rule memory 29 to cause it to read its contents in response to an address given by address table 28 into formant pattern generator 30 which is also controlled to provide its output to a parameter converter 31.

Parameter address table 24 holds parameter-related phoneme strings as its entries, starting addresses respectively corresponding to the entries and identifying the beginning of storage locations of memory 25, and numbers of data sets contained in each storage location of memory 25. For example, the phoneme string "[s]ei" has a corresponding starting address "XXXXX" of a location of memory 25 in which "400" data sets are stored.

According to linear predictive coding techniques, coefficients known as AR (Auto-Regressive) parameters are used as equivalents to LPC parameters. These parameters can be obtained by a computer analysis of human speech with a relatively small amount of computations to approximate the spectrum of speech, while ensuring a high level of articulation. Parameter memory 25 stores the AR parameters as well as ARMA (Auto-Regressis Moving Average) parameters which are also known in the art. As shown in FIG. 2, parameter memory 25 stores source codes, AR parameters $a_i$ and MA parameters $b_i$ (where $i=1,2,3, \ldots N, N+1, \ldots 2N$). Data in each item are addressed by a starting address supplied from parameter address table 24. The source code includes entries for identifying the type of a source wave (noise or periodic pulse) and the amplitude of the source wave. A starting address is supplied from 24 to memory 25 to read a source code and AR and MA parameters in the amount as indicated by the corresponding quantity data. The AR parameters are supplied in the form of a series of digital data $a_1, a_2, a_3, \ldots a_N, a_{N+1}, \ldots a_{2N}$ and the MA parameters as a series of digital data $b_1, b_2, \ldots b_N, b_{N+1}, \ldots b_{2N}$ and coupled through the right position of switch 27 to synthesizer 32.

Formant rule address table 28 contains phoneme strings as its entries and addresses of the formant rule memory 29 corresponding to the phoneme strings. In response to a phoneme string supplied from analyzer 21, a corresponding address is read out of address table 28 into formant rule memory 29.

As shown in FIG. 3, formant rule memory 29 stores a set of formants and preferably a set of antiformants that are used by formant pattern generator 30 to generate formant transition patterns. Each formant is defined by frequency data F $(t_i, f_i)$ and bandwidth data B $(t_i, b_i)$, where t indicates time, f indicates frequency, and b indicates bandwidth, and each antiformant is defined by frequency data AF $(t_i, f_i)$ and bandwidth data AB $(t_i, f_i)$. The formants and antiformants data are sequentially read out of memory 29 into formant pattern generator 30 as a function of a corresponding address supplied from address table 28. Formant pattern generator 30 produces a set of frequency and bandwidth parameters for each formant transition and supplies its output to parameter converter 31. Details of formant pattern generator 30 are described in pages 84 to 90 of "Speech Synthesis And Recognition" referred to above.

The effect of parameter converter 31 is to convert the formant parameter sequence from pattern generator 30 into a sequence of speech synthesis parameters of the same format as those stored in parameter memory 25.

As illustrated in FIG. 4, parameter converter 31 comprises a coefficients memory 40, a coefficient generator 41, a digital all-zero filter 42 and a digital unit impulse generator 43. Memory 40 includes a frequency table 50 and a bandwidth table 51 for respectively receiving frequency and bandwidth parameters from the formant pattern generator 30. Each of the frequency parameters in table 50 is recalled in response to the frequency value F or AF from the formant pattern generator 30 and represents the cosine of the displacement angle of a resonance pole for each formant frequency as given by $C=\cos(2\pi F/f_s)$, where F is the frequency parameter of either a formant or antiformant parameter and $f_s$ represents the sampling frequency. On the other hand, each of the parameters in table 51 is recalled in response to the bandwidth value B or AB from the pattern generator 30 and represents the radius of the pole for each bandwidth as given by $R=\exp(-\pi B/f_s)$, where B is the bandwidth parameter from generator 30 for both formants and antiformants.

Coefficient generator 41 is made up of a C-register 52 and an R-register 53 which are connected to receive data from tables 50 and 51, respectively. The output of C-register 52 is multiplied by "2" by a multiplier 54 and supplied through a switch 55 to a multiplier 56 where it is multiplied with the output of R-register 53 to produce a first-order coefficient A which is equal to $2\times C\times R$ when switch 55 is positioned to the left in response to a timing signal from controller 23. When switch 55 is positioned to the right in response to a timing signal from controller 23, the output of R-register 53 is squared by multiplier 56 to produce a second-order coefficient B which is equal to by $R\times R$.

Figure 5:
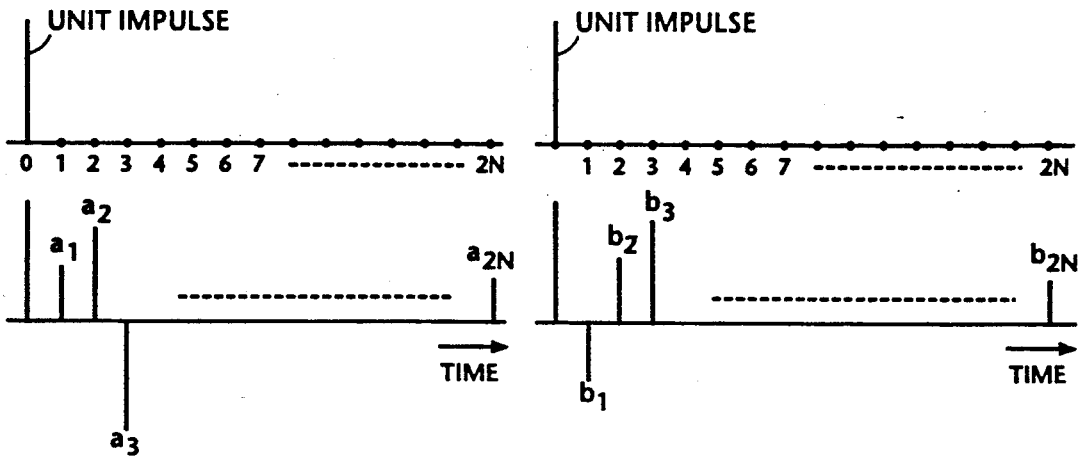
FIG. 5 is a timing diagram associated with the parameter converter of FIG. 4.

Digital all-zero filter 42 comprises a selector means 57 and a series of digital second-order transversal filters 58-1~58-N which are connected from unit impulse generator 43 to the left position of switch 27. The signals A and B from generator 41 are alternately supplied through selector 57 as a sequence $(-A_1, B_1), (-A_2, B_2), \ldots (-A_N, B_N)$ to transversal filters 58-1~58-N, respectively. Each transversal filter comprises a tapped delay line consisting of delay elements 60 and 61. Multipliers 62 and 63 are coupled respectively to successive taps of the delay line for multiplying digital values appearing at the respective taps with the digital values A and B from selector 57. The output of impulse generator 43 and the outputs of multipliers 62 and 63 are summed altogether by an adder 64 and fed to a succeeding transversal filter. Data representing a unit impulse is generated by impulse generator 43 in response to an enable pulse from controller 23. This unit impulse is successively converted into a series of impulse responses, or digital values $a_1 \sim a_{2N}$ of different height and polarity as formant parameters as shown in FIG. 5, and supplied through the left position of switch 27 to speech synthesizer 32. Likewise, a series of digital values $b_1 \sim b_{2N}$ is generated as antiformant parameters in response to a subsequent digital unit impulse.

Figure 6:
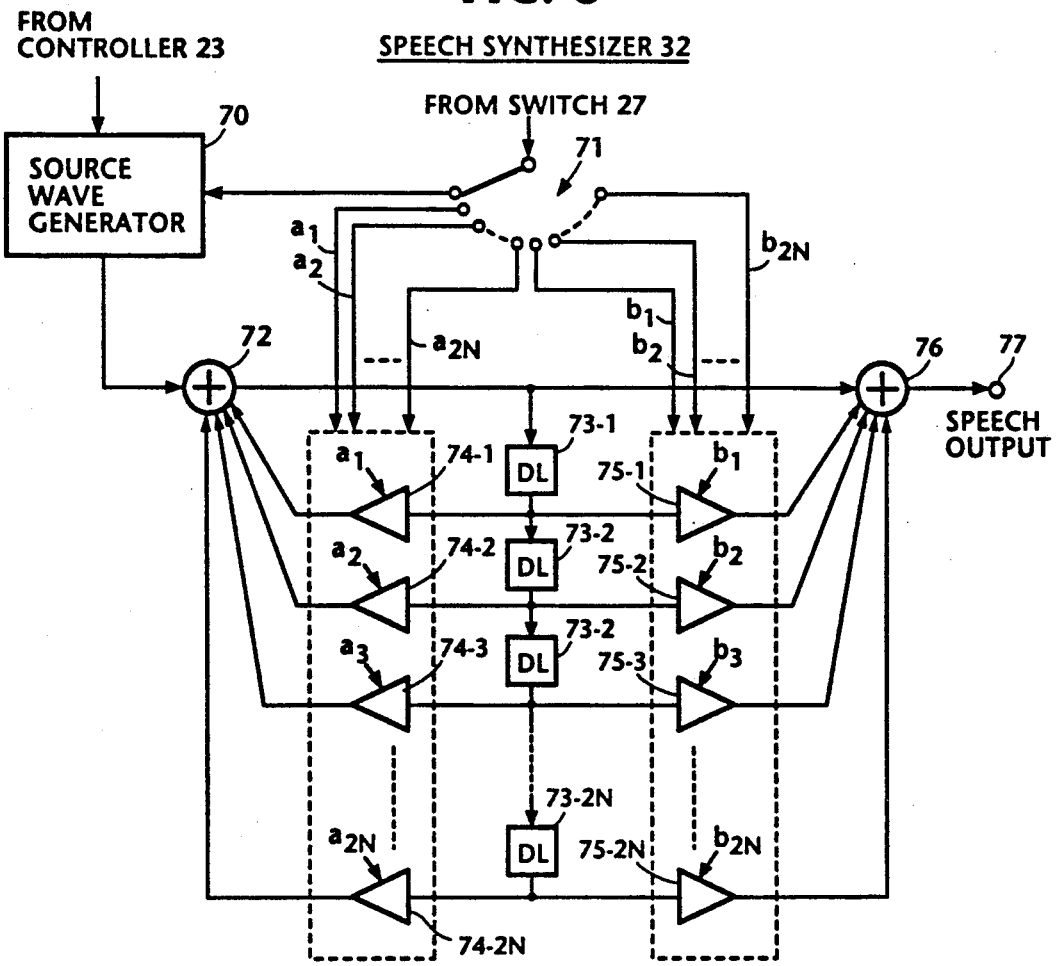
FIG. 6 is a block diagram of the digital speech synthesizer of FIG. 1.

In FIG. 6, speech synthesizer 32 is shown as comprising a digital source wave generator 70 which generates noise or a periodic pulse in digital form. During a parameter synthesis mode, speech synthesizer 32 is responsive to a source code supplied through a selector means 71 from the output of switch 27 and during a rule synthesis mode it is responsive to a source code supplied from controller 23. The output of source wave generator 71 is fed to an input adder 72 whose output is coupled to an output adder 76. A tapped delay line consisting of delay elements 73-1~73-2N is connected to the output of adder 72 and tap-weight multipliers 74-1~74-2N are connected respectively to successive taps of the delay line to supply weighted successive outputs to input adder 72. Similarly, tap-weight multipliers 75-1~75-2N are connected respectively to successive taps of the delay line to supply weighted successive outputs to output adder 76. The tap weights of multipliers 74-1 to 74-2N are respectively controlled by the tap-weight values $a_1$ through $a_{2N}$ supplied sequentially through selector 70 to reflect the AR parameters and those of multipliers 75-1 to 75-2N are respectively controlled by the digital values $b_1$ through $b_{2N}$ which are also supplied sequentially through selector 70 to reflect the ARMA parameters. In this way, spoken words are digitally synthesized at the output of adder 76 and coupled through an output terminal 77 to a digital-to-analog converter, not shown, where it is converted to analog form.

The foregoing description shows only one preferred embodiment of the present invention. Various modifications are apparent to those skilled in the art without departing from the scope of the present invention which is only limited by the appended claims. For example, the ARMA parameters could be dispensed with depending on the degree of qualities required.

What is claimed is:

1. A text-to-speech synthesizer comprising:

analyzer means for decomposing a sequence of input characters into phoneme components and classifying the decomposed phoneme components as a first group of phoneme components if each phoneme component is to be synthesized by a speech parameter and classifying said phoneme components as a second group of phoneme components if each phoneme component is to be synthesized by a formant rule;

first memory means for storing speech parameters derived from natural human speech, said speech parameters corresponding to the phoneme components of said first group and being retrievable from said first memory means in response to each of the phoneme components of the first group;

second memory means for storing formant rules for generating formant transition patterns, said formant rules corresponding to the phoneme components of said second group and being retrievable from said second memory means in response to each of the phoneme components of the second group;

means for retrieving a speech parameter from said first memory means in response to one of the phoneme components of the first group;

means for retrieving a formant rule from said second memory means in response to one of said phoneme components of the second group and deriving a formant transition pattern from the retrieved formant rule;

parameter converter means for converting a formant of said derived formant transition pattern into a corresponding speech parameter; and speech synthesizer means for synthesizing a human speech utterance from the speech parameter retrieved from said first memory means and synthesizing a human speech utterance from the speech parameter converted by said parameter converter means, wherein said speech parameters stored in said first memory means are represented by auto-regressive (AR) parameters, and said formant of said derived formant transition patterns are represented by frequency and bandwidth values, wherein said parameter converter means comprises:

means for converting the frequency value of said formant into a value equal to $C=\cos(2\pi F/f_s)$, where F is said frequency value and $f_s$ represents a sampling frequency, and converting the bandwidth value of said formant into a value equal to $R=\exp(-\pi B/f_s)$, where B is the bandwidth value;

means for generating a first signal representative of a value $2\times C\times R$ and a second signal representative of a value $R^2$;

unit impulse generator for generating a unit impulse; and a series of second-order transversal filters connected in series from said unit impulse generator to said speech synthesizer means, each of said second-order transversal filters including a tapped delay line, first and second tap-weight multipliers connected respectively to successive taps of said tapped delay line, and an adder for summing the outputs of said multipliers with said unit impulse, said first and second multipliers multiplying signals at said successive taps with said first and second signals, respectively.

2. A text-to-speech synthesizer as claimed in claim 1, wherein said analyzer means comprises a table for mapping relationships between a plurality of phoneme component strings and corresponding indications classifying said phoneme component strings as falling into one of said first and second groups, and means for detecting a match between a decomposed phoneme component and a phoneme component in said phoneme component strings and classifying the decomposed phoneme component as one of said first and second groups according to the corresponding indication if said match is detected.

3. A text-to-speech synthesizer as claimed in claim 1, wherein said speech synthesizer means comprises:

source wave generator means for generating a source wave;

input and output adders connected in series from said source wave generator means to an output terminal of said text-to-speech synthesizer;

a tapped delay line connected to the output of said input adder;

a plurality of first tap-weight multipliers having input terminals respectively connected to successive taps of said tapped-delay line and output terminals connected to input terminals of said input adder, said first tap-weight multipliers respectively multiplying signals at said successive taps with signals supplied from said first memory means and said parameter converter means; and a plurality of second tap-weight multipliers having input terminals respectively connected to successive taps of said tapped-delay line and output terminals connected to input terminals of said output adder, said second tap-weight multipliers respectively multiplying signals at said successive taps with signals supplied from said first memory means and said parameter converter means.

4. A text-to-speech synthesizer comprising:

analyzer means for decomposing a sequence of input characters into phoneme components and classifying the decomposed phoneme components as a first group of phoneme components if each phoneme component is to be synthesized by a speech parameter and classifying said phoneme components as a second group of phoneme components if each phoneme component is to be synthesized by a formant rule;

first memory means for storing speech parameters derived from natural human speech, said speech parameters corresponding to the phoneme components of said first group and being retrievable from said first memory means in response to each of the phoneme components of the first group;

second memory means for storing formant rules for generating formant transition patterns, said formant rules corresponding to the phoneme components of said second group and being retrievable from said second memory means in response to each of the phoneme components of the second group;

means for retrieving a speech parameter from said first memory means in response to one of the phoneme components of the first group;

means for retrieving a formant rule from said second memory means in response to one of said phoneme components of the second group and deriving a formant transition pattern from the retrieved formant rule;

parameter converter means for converting a formant of said derived formant transition pattern into a corresponding speech parameter; and speech synthesizer means for synthesizing a human speech utterance from the speech parameter retrieved from said first memory means and synthesizing a human speech utterance from the speech parameter converted by said parameter converter means, wherein said speech parameters in said first memory means are represented by auto-regressive (AR) parameters and auto-negressive moving average (ARMA) parameters, and said formant rules in said second memory means being further capable of generating antiformant transition patterns, each of said formants and said antiformants being represented by frequency and bandwidth values, wherein said parameter converter means comprises:

means for converting the frequency value of said formant into a value equal to $C=\cos(2\pi F/f_s)$, where F is said frequency value and $f_s$ represents a sampling frequency, and converting the bandwidth value of said formant into a value equal to $R=\exp(-\pi B/f_s)$, where B is the bandwidth value;

means for generating a first signal representative of a value $2\times C\times R$ and a second signal representative of a value $R^2$;

unit impulse generator means for generating a unit impulse; and a series of second-order transversal filters connected in series from said unit impulse generator to said speech synthesizer means, each of said second-order transversal filters including a tapped delay line, first and second tap-weight multipliers connected respectively to successive taps of said tapped delay line, and an adder for summing the outputs of said multipliers with said unit impulse, said first and second multipliers multiplying signals at said successive taps with said first and second signals, respectively.

5. A text-to-speech synthesizer as claimed in claim 4, wherein said analyzer means comprises a table for mapping relationships between a plurality of phoneme component strings and corresponding indications classifying said phoneme component strings as falling into one of said first and second groups, and means for detecting a match between a decomposed phoneme component and a phoneme component in said phoneme component strings and classifying the decomposed phoneme component as one of said first and second groups according to the corresponding indication if said match is detected.

6. A text-to-speech synthesizer as claimed in claim 4, wherein said speech synthesizer means comprises:

source wave generator means for generating a source wave;

input and output adders connected in series from said source wave generator means to an output terminal of said text-to-speech synthesizer;

a tapped delay line connected to the output of said input adder;

a plurality of first tap-weight multipliers having input terminals respectively connected to successive taps of said tapper-delay line and output terminals connected to input terminals of said input adder, said first tap-weight multipliers respectively multiplying signals at said successive taps with signals supplied from said first memory means and said parameter converter means; and a plurality of second tap-weight multipliers having input terminals respectively connected to successive taps of said tapped-delay line and output terminals connected to input terminals of said output adder, said second tap-weight multipliers respectively multiplying signals at said successive taps with signals supplied from said first memory means and said parameter converter means.

* * * * *